US006358019B1

(12) United States Patent
Iversen et al.

(10) Patent No.: US 6,358,019 B1
(45) Date of Patent: Mar. 19, 2002

(54) SUCTION SOUND DAMPER FOR A HERMETICALLY ENCAPSULATED COMPRESSOR

(75) Inventors: Frank Holm Iversen, Padborg; Jan Thomsen, Aabenraa, both of (DK)

(73) Assignee: Danfoss Compressors GmbH, Flensburg (DE)

( * ) Notice: Subject to any disclaimer, the term of this patent is extended or adjusted under 35 U.S.C. 154(b) by 0 days.

(21) Appl. No.: 09/566,705

(22) Filed: May 9, 2000

(30) Foreign Application Priority Data

May 22, 1999 (DE) ..... 199 23 734

(51) Int. Cl.[7] ..... F04B 39/00; F04B 53/00
(52) U.S. Cl. ..... 417/312; 181/403
(58) Field of Search ..... 417/312, 902; 181/403

(56) References Cited

U.S. PATENT DOCUMENTS 4,759,693 A * 7/1988 Outzen ..... 417/312
4,960,368 A * 10/1990 Lilie ..... 417/312
5,542,824 A * 8/1996 Lee ..... 417/312
5,669,762 A * 9/1997 Lee ..... 417/312
5,733,106 A * 3/1998 Lee ..... 417/312
5,971,720 A * 10/1999 Fagotti et al. ..... 417/312
6,017,197 A * 1/2000 Jensen et al. ..... 417/312

* cited by examiner

*Primary Examiner*—Charles G. Freay
*Assistant Examiner*—William Rodriguez
(74) *Attorney, Agent, or Firm*—Lee, Mann, Smith, McWilliams, Sweeney & Ohlson

(57) ABSTRACT

A suction sound damper for a hermetically encapsulated compressor has a housing that is formed of at least an upper part (3), a lower part (1) and an insert (2), and having at least two chambers (7, 8) and a channel (9), connected thereto, leading from a lower inlet opening (10) to an upper outlet opening (11). The insert (2) has a side wall (18) which, together with a section (19) of the housing wall, forms a capillary gap (20) in which lubricating oil collects and is retained. This produces additional sound damping.

13 Claims, 3 Drawing Sheets

SUCTION SOUND DAMPER FOR A HERMETICALLY ENCAPSULATED COMPRESSOR

BACKGROUND OF THE INVENTION

The invention relates to a suction sound damper for a hermetically encapsulated compressor, having a housing that is formed of at least an upper part, a lower part and an insert, and having at least two chambers and a channel, connected thereto, leading from a lower inlet opening to an upper outlet opening.

In a known suction sound damper of that type (U.S. Pat. No. 5,201,640), which is designed for hermetically encapsulated small refrigerating machines, as used in household refrigerators and the like, the inner area is divided into two chambers by a vertical wall. With the aid of an insert a channel is formed which alters the direction of flow of the suction gas several times. The upper part has an extension that contains the final channel section and fits into a recess in the cylinder head cover so that the entire suction sound damper can be secured to the cylinder head.

From U.S. Pat. No. 3,750,840 there is known a sound damper for a hermetically encapsulated compressor in which a pot-shaped lower part and a pot-shaped upper part are pushed over one another telescopically and are welded to one another. Held in the lower part is an insert that divides the inner area of the sound damper into an upper and lower chamber and, together with a shaped piece of sheet metal, forms a throttle channel between the two chambers. Input is effected by way of a tube positioned at the top and the outlet is effected by way of a laterally adjoining tube at the bottom.

From U.S. Pat. No. 3,220,506 there is known a sound damper for internal combustion machines that release water and gas. Two pot-shaped parts are inserted into one another horizontally and receive between them the flange of a similarly pot-shaped insert. There remains between the insert and the outer structural part an annular space into which water and exhaust gases from the motor are fed by way of holes in the flange of the insert.

The problem underlying the invention is to provide a suction sound damper of the type described at the beginning that provides improved sound damping.

SUMMARY OF THE INVENTION

The problem is solved according to the invention by the fact that the insert has a side wall that together with a section of the housing wall forms a capillary gap in which lubricating oil collects and is retained.

In that construction the oil layer in the capillary gap provides extra damping in addition to the other damping measures. Since the suction gas always entrains a certain amount of lubricating oil with it, the capillary gap automatically fills up with oil after a short period of operation.

It is advantageous for the capillary gap to be located at a two-dimensionally curved section of the housing wall. Firstly, the capillary gap can be formed with high precision when the curvature is two-dimensional. Secondly, two-dimensionally curved wall sections are at substantially greater risk of vibratory excitation than are three-dimensionally curved wall sections. The damping is therefore effected directly at the location at which the sound radiation occurs.

It is recommended that the insert divide the inner area of the housing into an upper chamber and a lower chamber. The simple structural shape can therefore be retained even when the side wall necessary to form the capillary gap is used.

It is advantageous for the capillary gap to be open towards the lower chamber. Since the capillary gap also fills up from below, this results in great freedom of design. In particular, the upper chamber can be made to be relatively large and in any case larger than the lower chamber, which improves the degree of filling.

In a further construction the insert is provided with a base that is inclined to the horizontal and at the lowest point has a discharge opening leading to the lower chamber. Any oil deposited in the upper chamber is immediately drained away below.

In a further construction the lower part is provided with a base that is inclined to the horizontal, the lowest point of which is connected to the inlet opening. Oil that has reached the lower chamber can be drained off by way of the inlet opening.

It is also advantageous for the lower part to have a first channel section connected to the inlet opening, for the insert to have a tube-shaped second channel section and for the upper part to have a third channel section connected to the outlet opening. Each of the three structural parts (lower part, insert, upper part) thus has a channel section. The complete channel is then produced automatically when the three parts are assembled together.

It is recommended that the three channel sections be arranged approximately in a straight line. This means that the gas that is drawn in can flow virtually in a straight line from the inlet opening to the outlet opening. The losses of flow are correspondingly small and the degree of filling of the compressor is correspondingly high.

An especially simple option for connecting the channel to the chambers is for the channel sections to be arranged spaced from one another or for the channel walls to be provided with radial openings.

In a further construction of the invention, the insert has, in addition to the tube-shaped second channel section, a laterally offset connecting opening between the two chambers. That connecting opening results in a phase shift in the build-up of pressure in the suction sound damper and can be so constructed in terms of its position, size and shape that pressure pulses are reduced at least to some extent by interference.

It is also advantageous that the volume of the chambers be sufficiently large that the compressor stroke chamber during the suction stroke is filled essentially wholly by gas contained in the suction sound damper. The suction sound damper then serves as a suction gas reservoir, which means that the suction gas has to travel only a short path to the stroke chamber of the compressor and not from the inlet of the suction sound damper. The resistance to suction is correspondingly low and the degree of filling of the compressor is correspondingly high.

It is advantageous for the upper part and lower part to be connected to one another at flanges and receive between them a flange of the insert. This form of assembly known per se ensures precise association of the individual parts with one another.

In a preferred embodiment, moreover, the upper part is provided with a tube-shaped extension that fits into an indentation in the cylinder head cover, and with a three-point support for contact against the valve plate of the compressor or against a seal arranged between the cylinder head cover and the valve plate, which seal encloses the contact surfaces of the outlet opening and of two supports, at least one of which is spaced from the tube-shaped extension. The three-point support provides an especially secure position of the suction sound damper on the compressor head.

BRIEF DESCRIPTION OF THE DRAWINGS

The invention will be described hereinafter in greater detail with reference to a preferred embodiment in conjunction with the drawings, in which.

DESCRIPTION OF THE PREFERRED EMBODIMENT

Figure 1:
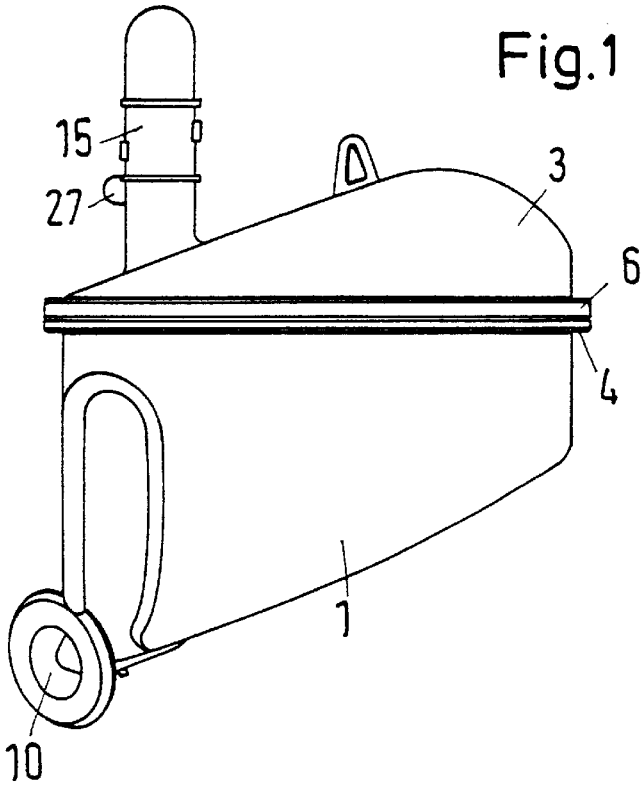
FIG. 1 shows a suction sound damper according to the invention, from the outside.
Figure 2:
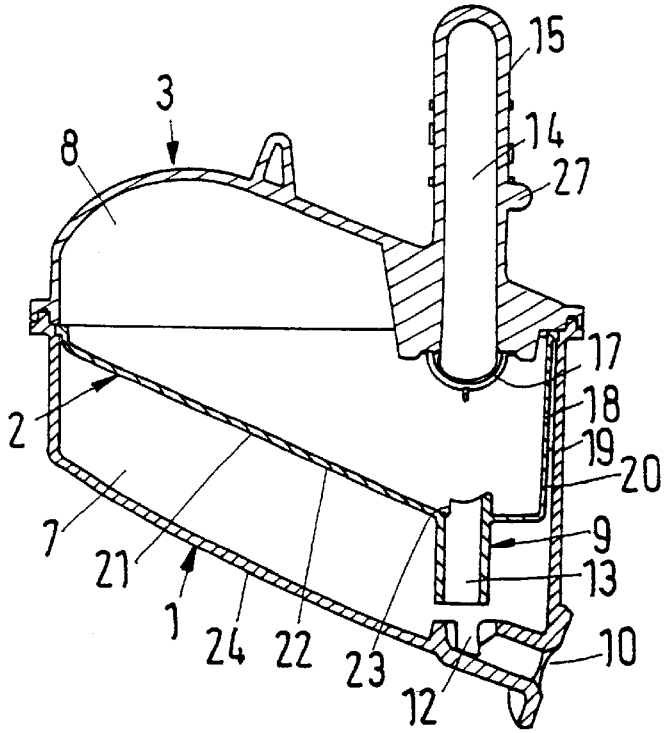
FIG. 2 is a vertical section through the suction sound damper of FIG. 1.

The suction sound damper shown in FIGS. 1 to 5 has essentially a lower part 1, an insert 2 and an upper part 3. The parts are made of a plastics material, for example polybutylene terephthalate (PBTP), and are joined to one another at their flanges 4, 5 and 6 by vibration welding, the flange 5 of the insert 2 being held between the upper part 3 and the lower part 1.

Figure 3:
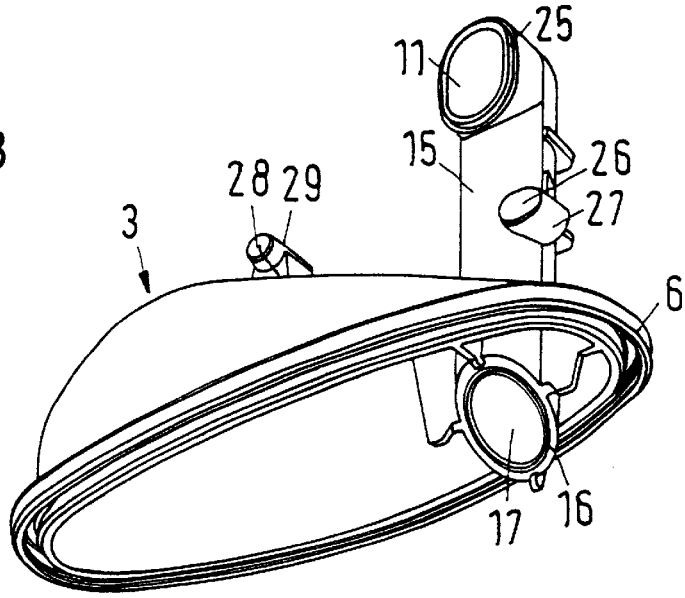
FIG. 3 shows the upper part of the suction sound damper.
Figure 4:
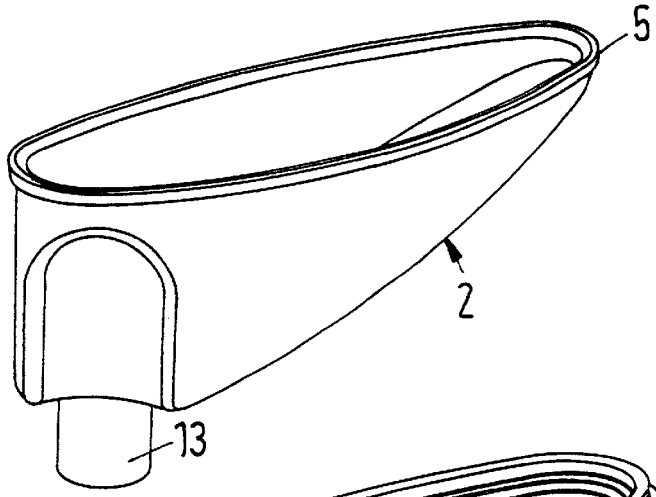
FIG. 4 shows the associated insert.
Figure 5:
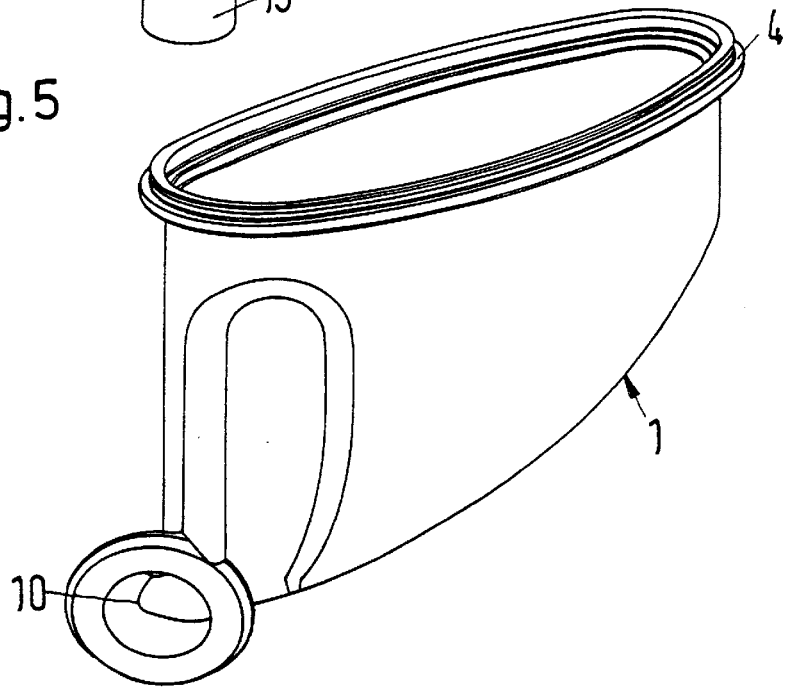
FIG. 5 shows the lower part of the suction sound damper.
Figure 6:
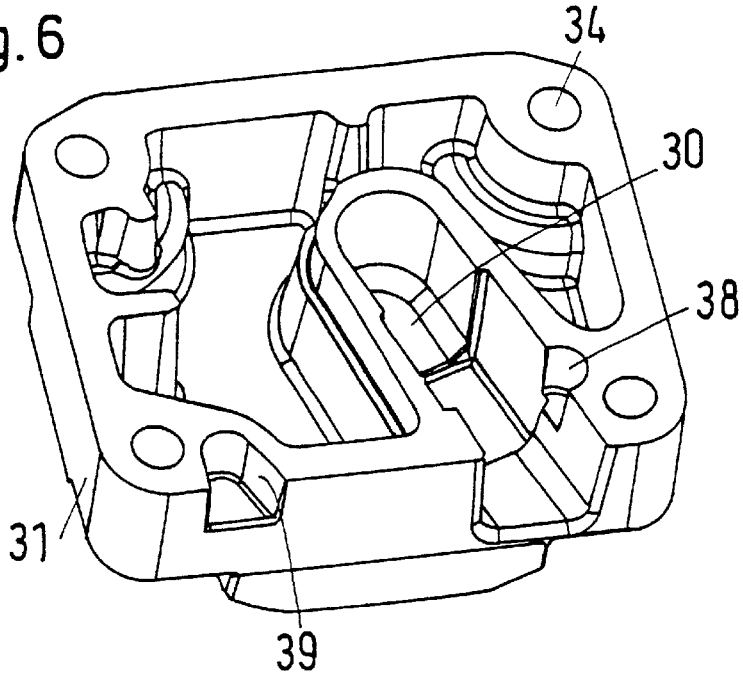
FIG. 6 is a perspective view of a cylinder head cover.

The insert 2 divides the inner area of the suction sound damper into a lower chamber 7 and an upper chamber 8. These are in communication with a channel 9 running from a lower inlet opening 10 to an upper outlet opening 11 (FIG. 3). A first channel section 12 at the lower part 1, a tube-shaped second channel section 13 at the insert and a third channel section 14, which extends into an extension 15 of the upper part 3, extend along an approximately straight line. Between the channel sections 12 and 13 and 13 and 14 there is a gap which provides the connection to the lower chamber 7 and to the upper chamber 8, respectively. The inlet 16 into the third channel section 14 is covered by a filter 17.

Instead of the gaps shown, the channel sections can also lie contiguous to one another and the connection to the chambers 7 and 8 can be provided by radial openings in the channel wall.

The insert 2 has a side wall 18 which, together with a preferably only two-dimensionally curved section 19 of the circumferential wall of the lower part 1, form a capillary gap 20. On account of the capillary action, during operation the capillary gap fills up with oil which, in encapsulated compressor systems, is entrained by the gas and remains in the capillary gap 20. This results in an additional damping action. The capillary gap 20 is not limited to the section shown in FIG. 2, but may extend around the entire circumference of the insert.

The two chambers 7 and 8 are connected not only by the second channel section 13 but also by an opening 21 in the base 22 of the insert 2. The position, size and shape of the opening 21 can be so selected that the increases in pressure occur with a phase shift and thus some of the sound vibrations are eliminated by interference. The suction sound damper has very good damping properties, however, even without the opening 21.

The base 22 of the insert 2 is inclined to the horizontal and has at the lower end a discharge opening 23 through which deposited oil can drain off into the lower chamber 7. In similar manner the lower part 1 has a base 24 that is inclined to the horizontal, the lower end of which is in communication with the inlet opening 10 so that there also the oil can drain away. Just a few degrees of inclination to the horizontal will suffice for this oil requirement.

The upper chamber 8 is considerably larger than the lower chamber 7. Moreover, the third channel section 14 is designed to be relatively low in resistance. During the suction stroke, the motor compressor essentially draws gas in from the upper chamber 8, which serves as a gas reservoir. The suction gas thus only has to be transported a relatively short path, low in resistance, to the stroke chamber of the compressor, which is possible without large losses in flow so that a high degree of filling is achieved. This is promoted by the fact that any compressed gas flowing behind is delivered in a straight line and thus with low flow resistance.

Figure 7:
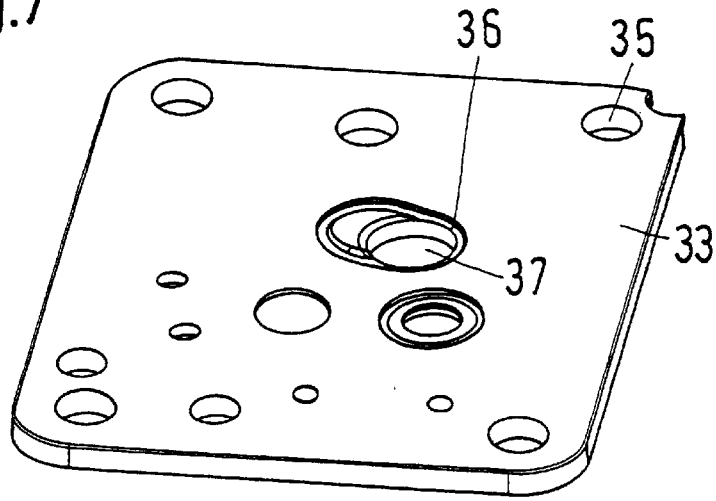
FIG. 7 is a perspective view of a valve plate.
Figure 8:
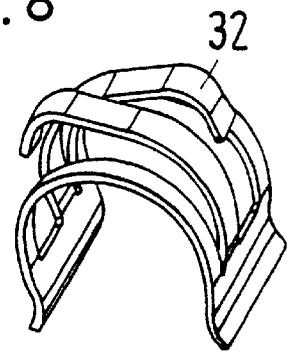
FIG. 8 shows a spring clip.

The suction sound damper is carried by the compressor. For that purpose the upper part 3 has three contact surfaces, namely a contact surface 25 at the circumference of the outlet opening 11, a contact surface 26 at a support 27 near the extension 15 and a contact surface 28 at a support 29 spaced from the extension 15. To fasten it, the extension 15 is positioned in a hole 30 in a cylinder head cover 31 and is fixed there by a spring clip 32 (which is shown slightly enlarged in FIG. 8). That arrangement is then positioned from above on a valve plate 33 (FIG. 7) which, together with the cylinder head cover, is secured to the compressor in customary manner—with seals (not shown) being placed in between—by screws that pass through the holes 34 and 35. The contact surface 25 rests on an indentation 36 in the valve plate 33 and on the seal (not shown) and the outlet opening 11 is in communication with the suction opening 37. At the same time, the contact surfaces 26 and 28 are supported, respectively, on the valve plate 33 and on the seal, resulting in good secure positioning. The associated supports 27 and 29 engage in corresponding holes 38 and 39 in the cylinder head cover 31 so that the parts are aligned with one another precisely.

The above has described a series of measures, each of which in itself provides an improvement in the sound damping and each of which therefore can be used on its own. Better results are of course obtained when several or all of the measures are implemented jointly.

What is claimed is:

1. Suction sound damper for a hermetically encapsulated compressor having a housing that is formed of at least an upper part, a lower part and an insert, the suction sound damper having at least two chambers and a channel, connected thereto, leading from a lower inlet opening to an upper outlet opening, and in which the insert has a side wall which, together with a section of the housing, forms a gap between the side wall and the housing section in which lubricating oil collects and is retained.

2. Suction sound damper according to claim 1, in which the gap is located at a two-dimensionally curved section of the housing.

3. Suction sound damper according to claim 1, in which the insert divides an inner area of the housing into an upper chamber and a lower chamber.

4. Suction sound damper according to claim 3, in which the gap is open towards the lower chamber.

5. Suction sound damper according to claim 3, in which the insert has a base that is inclined to horizontal and at a lowest point has a discharge opening leading to the lower chamber.

6. Suction sound damper according to claim 3, in which the lower part has a base that is inclined to horizontal, a lowest point of which is connected to the inlet opening.

7. Suction sound damper according to claim 3, in which the lower part has a first channel section connected to the inlet opening, the insert has a tube-shaped second channel section and the upper part has a third channel section connected to the outlet opening.

8. Suction sound damper according to claim 7, in which the three channel sections are oriented approximately in a straight line.

9. Suction sound damper according to claim 7, in which the channel is connected to the chambers by virtue of the channel sections being spaced from one another.

10. Suction sound damper according to claim 7, in which the insert has in addition to the tube-shaped second channel section a laterally offset connecting opening between the two chambers.

11. Suction sound damper according to claim 3, in which the chambers have a volume sufficiently large that during a suction stroke a compressor stroke chamber is filled essentially wholly by gas contained in the suction sound damper.

12. Suction sound damper according to claim 1, in which the upper and lower parts are connected to one another at flanges and receive between them a flange of the insert.

13. Suction sound damper according to claim 1, in which the upper part has a tube-shaped extension that fits into an indentation in a cylinder head cover, and having a three-point support for contact against a valve plate of a compressor or against a seal arranged between the cylinder head cover and the valve plate, which seal encloses contact surfaces of the outlet opening and if two supports, at least one of which is spaced from the tube-shaped extension.

* * * * *